US005129117A

United States Patent [19]

Celestina et al.

[11] Patent Number: 5,129,117

[45] Date of Patent: Jul. 14, 1992

[54] BIRTH ASSIST PROTECTION GUARD

[75] Inventors: Mary A. Celestina, Cincinnati, Ohio; David W. Williams, Batesville, Ind.; David C. Newkirk, Fairfield, Ohio

[73] Assignee: Hill-Rom Company, Inc., Batesville, Ind.

[21] Appl. No.: 619,103

[22] Filed: Nov. 28, 1990

[51] Int. Cl.[5] ..... A61G 7/00; A47C 27/08

[52] U.S. Cl. ..... 5/602; 5/613; 5/424; 5/430

[58] Field of Search ..... 5/424–430, 5/60, 66, 67–69

[56] References Cited

U.S. PATENT DOCUMENTS

| | | | |
|---|---|---|---|
| 3,506,989 | 4/1970 | Ross | 5/430 |
| 3,526,008 | 9/1970 | Pruim | 5/430 |
| 3,604,024 | 9/1971 | Polanski | 5/430 |
| 4,103,376 | 8/1978 | Benoit | 5/430 |
| 4,484,367 | 11/1984 | Jenkins | 5/425 |
| 4,509,217 | 4/1985 | Therrien | 5/428 |
| 4,612,679 | 9/1986 | Mitchell | 5/425 |
| 4,639,954 | 2/1987 | Speed | 5/66 |
| 4,641,385 | 2/1987 | Peters | 5/430 |
| 4,653,129 | 3/1987 | Kuck | 5/430 |

FOREIGN PATENT DOCUMENTS

| | | | |
|---|---|---|---|
| 456477 | 2/1928 | Fed. Rep. of Germany | 5/425 |

OTHER PUBLICATIONS

"650 High/Low", The Boring Corporation, date unknown.

*Primary Examiner*—Renee S. Luebke
*Assistant Examiner*—F. Saether
*Attorney, Agent, or Firm*—Wood, Herron & Evans

[57] ABSTRACT

A side guard for a hospital birthing bed has an elongated control panel and a shallow inverted U-shaped handrail extending from the front to the rear of the panel. The handrail is spaced from the panel and provides multiple positions for the mother to grip the panel during the time of her labor. A parallelogram linkage is provided for shifting the side guard from an operative position above the patient support to an inoperative position tucked below the patient support. A dashpot is provided to dampen the speed of the movement from the operative position to the inoperative position.

7 Claims, 5 Drawing Sheets

BIRTH ASSIST PROTECTION GUARD

BACKGROUND OF THE INVENTION

This invention relates to a side guard for a hospital bed and more particularly the invention relates to a side guard for a hospital birthing bed.

A birthing bed is a structure designed to provide comfort to the mother, to permit the mother to assume various positions that help in moving the baby along during contractions, and to facilitate the work of the attending gynecologist. The birthing bed to which the present invention is directed has a patient support consisting of three major panels, namely, a head panel against which the back of the patient can recline, a seat panel and a leg panel. As is customary in hospital beds, it has been common practice to provide side guards to prevent the patient's accidental falling out of the bed. In one form of birthing bed it has been known to provide, as a side guard, an elongated panel on which controls for manipulating the bed and performing other functions have been provided. That side guard has been mounted on the seat panel of the bed. A labor grip has been provided on the forward end of the panel. The panel has been mounted on parallelogram linkages that permit the side guard to swing in a path parallel to the longitudinal axis of the bed from an upper operative position to a lower inoperative position. When in the lower inoperative position, the side guards can be thrust inwardly out of the way under the bed. Thus, the shift from operative position to a storage position is a two-step operation.

The present invention is directed to improving the side guard in two principal respects, namely, its configuration and enhanced suitability for assisting in the laboring process; and its mounting for easy shifting from an upper operative position to a lower inoperative storage position.

Focusing first on the improved configuration, an objective of the present invention has been to expand the utility of the side guard.

This objective has been attained by providing an elongated, inverted U-shaped handrail surrounding the upper portion of the panel forming the side guard. The handrail is particularly useful in the laboring process. For example, it is contemplated that the mother can kneel on the leg or seat portion of the birthing bed, facing the head panel, and grip the side guard at any one of a number of longitudinal positions along its length, the mother being able to find the most ideal position for her given all of the circumstances of her size and condition. The handrail is also useful in assisting the mother in getting into and out of bed, the side guard being mounted on the head panel so that the mother can grip the side guard and swing about the seat panel to enter and exit the bed. Further, the side guard aids the patient in repositioning herself in bed, especially after surgery or the birthing process.

Focusing on the second feature of the invention, it has been an objective of the present invention to provide an improved mounting for the side guard enabling it to be moved quickly between its upper operative position and its lower storage position.

The latter objective of the invention is attained by mounting the side guard on a parallelogram linkage that causes the side guard to swing initially, outwardly away from the bed and then downwardly and inwardly to a storage position underneath the head panel of the bed.

A dashpot is connected between the side guard and the bed frame to reduce the velocity of the side guard as it drops to its lower position, thereby preventing any injury to the side guard and associated mechanism as well as preventing a disturbing clanking of the side guard as it drops to its lower position.

BRIEF DESCRIPTION OF THE DRAWINGS

The several features and objectives of the present invention will become more readily apparent from the following detailed description taken in conjunction with the accompanying drawings in which.

DETAILED DESCRIPTION OF A PREFERRED EMBODIMENT

Figures 1, 1A:
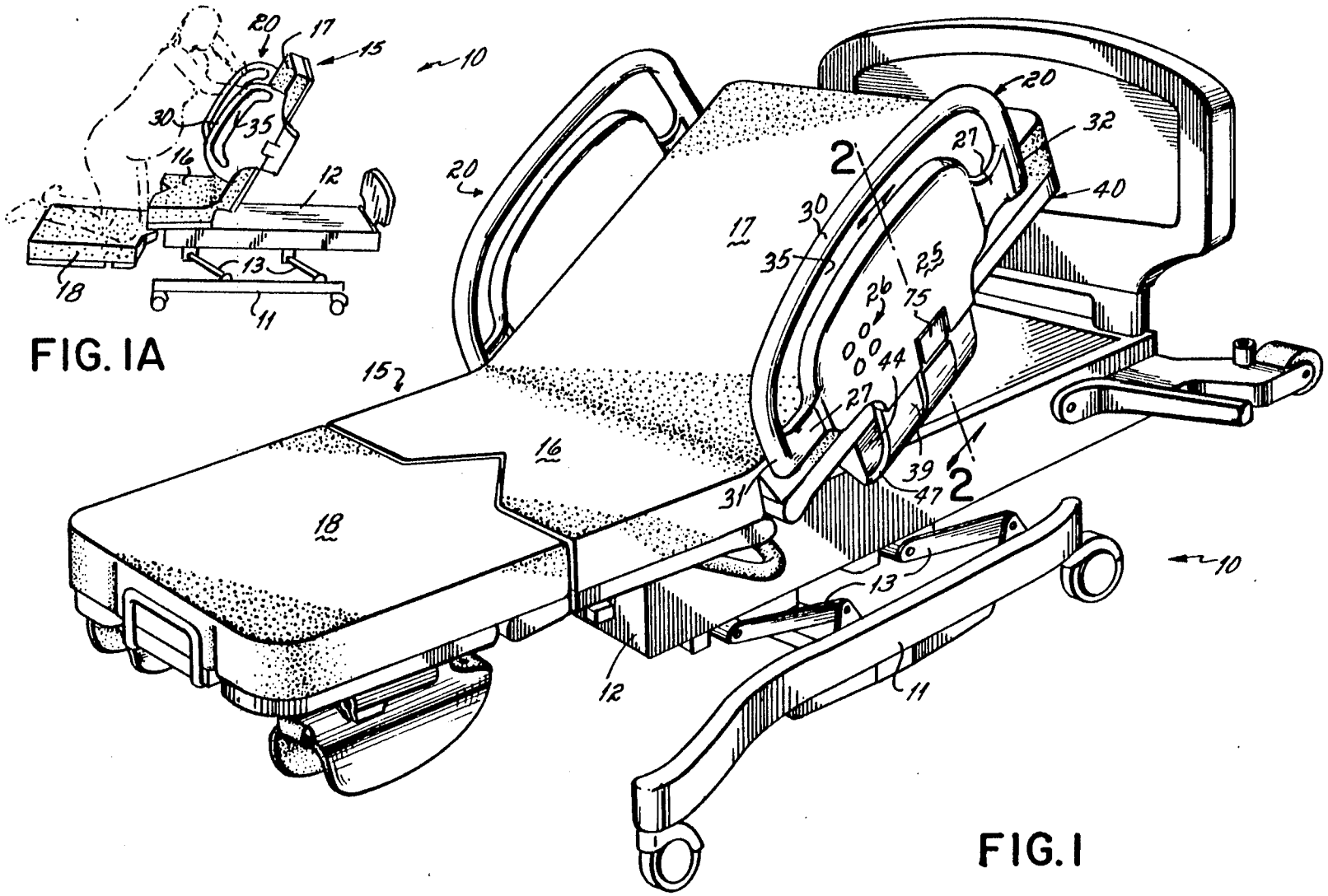
FIG. 1 is a perspective view of a birthing bed employing the present invention.
FIG. 1A is a diagrammatic perspective view of a birthing bed showing one principal way of utilizing the side guard of the present invention.

Referring to FIG. 1, a birthing bed 10 has a castered base 11 and a main frame 12 mounted on the base by a parallelogram linkage 13. Controls that are concealed by the frame 12 are provided for raising and lowering the frame with respect to the base 11.

Mounted on the frame 12 is a patient support 15 formed by a seat panel 16, a head panel 17 pivoted to the frame with respect to the seat panel 16 and a foot or leg panel 18. A special linkage mounted to the frame 12 is provided for raising and lowering the leg panel 18 with respect to the seat panel 16 while maintaining the leg panel 18 in a horizontal attitude. A mechanism is also provided for pivoting the head panel 17 from a horizontal attitude to an upwardly-inclined attitude such as is shown in FIG. 1 with an infinite number of angular positions in between.

The head panel has a side guard 20 on each side. The side guard 20 is mounted on the head panel and is movable with it. Each side guard has a central panel 25 on which finger touch controls 26 are mounted, the controls operating the several panels of the patient support 15. Projecting longitudinally from each end of the panel 25 are arms 27. An elongated shallow inverted U-shaped handrail 30 has a foot end 31 attached to one arm 27 and a head end 32 attached to the opposite arm 27, thereby mounting it to the panel 25. The handrail 30 is spaced throughout substantially its entire length from the panel 25 so as to leave a space 35 of substantial dimension, thereby enabling the mother to grasp the handrail 30 anywhere along its length as illustrated, for example, in FIG. 1A.

Figure 2:
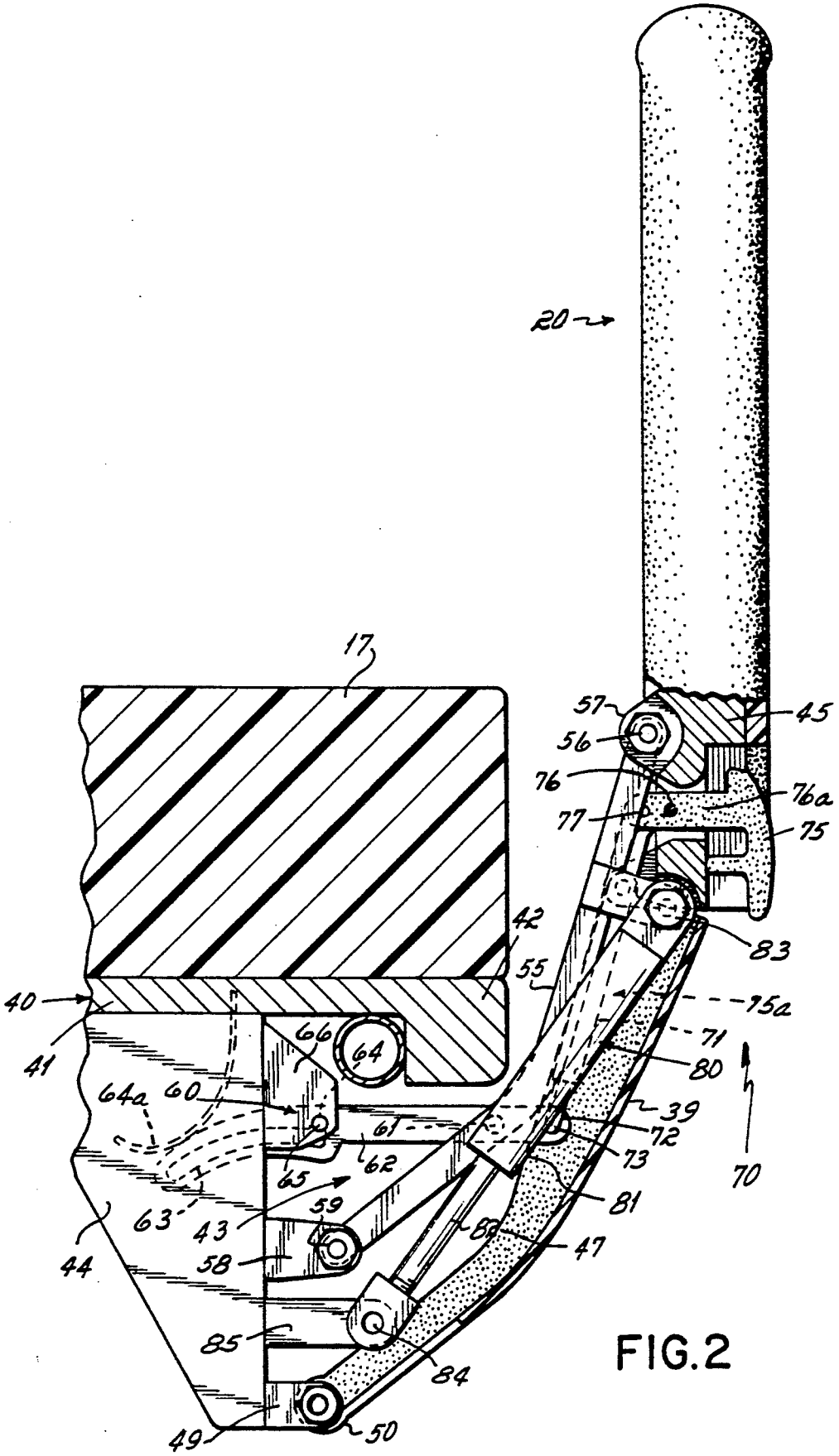
FIG. 2 is a cross-sectional view taken along lines 2—2 of FIG. 1.
Figure 2A:
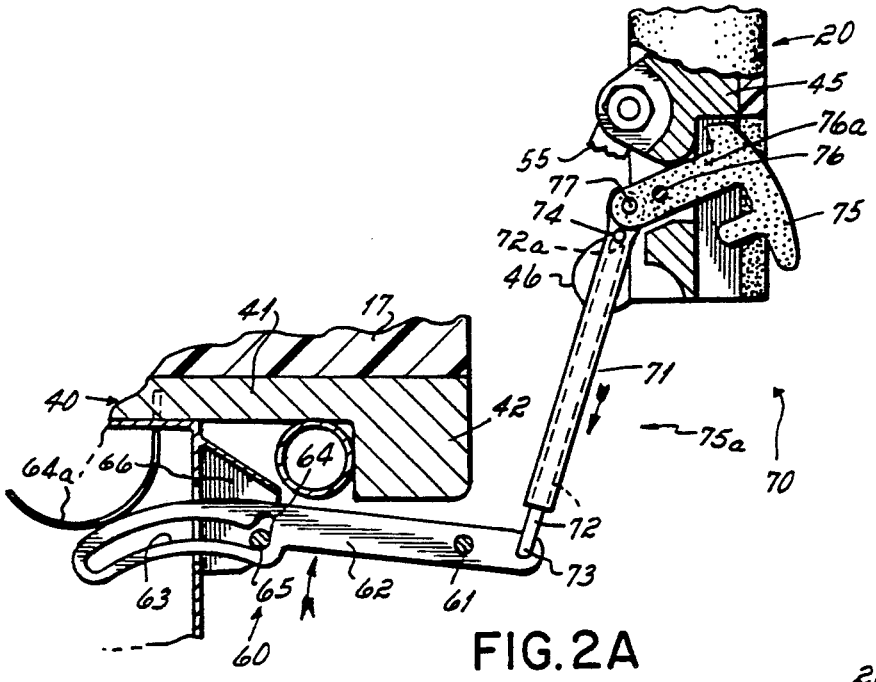
FIG. 2A is a fragmentary cross-sectional view with parts removed to show the latching mechanism for the side guard.
Figure 2B:
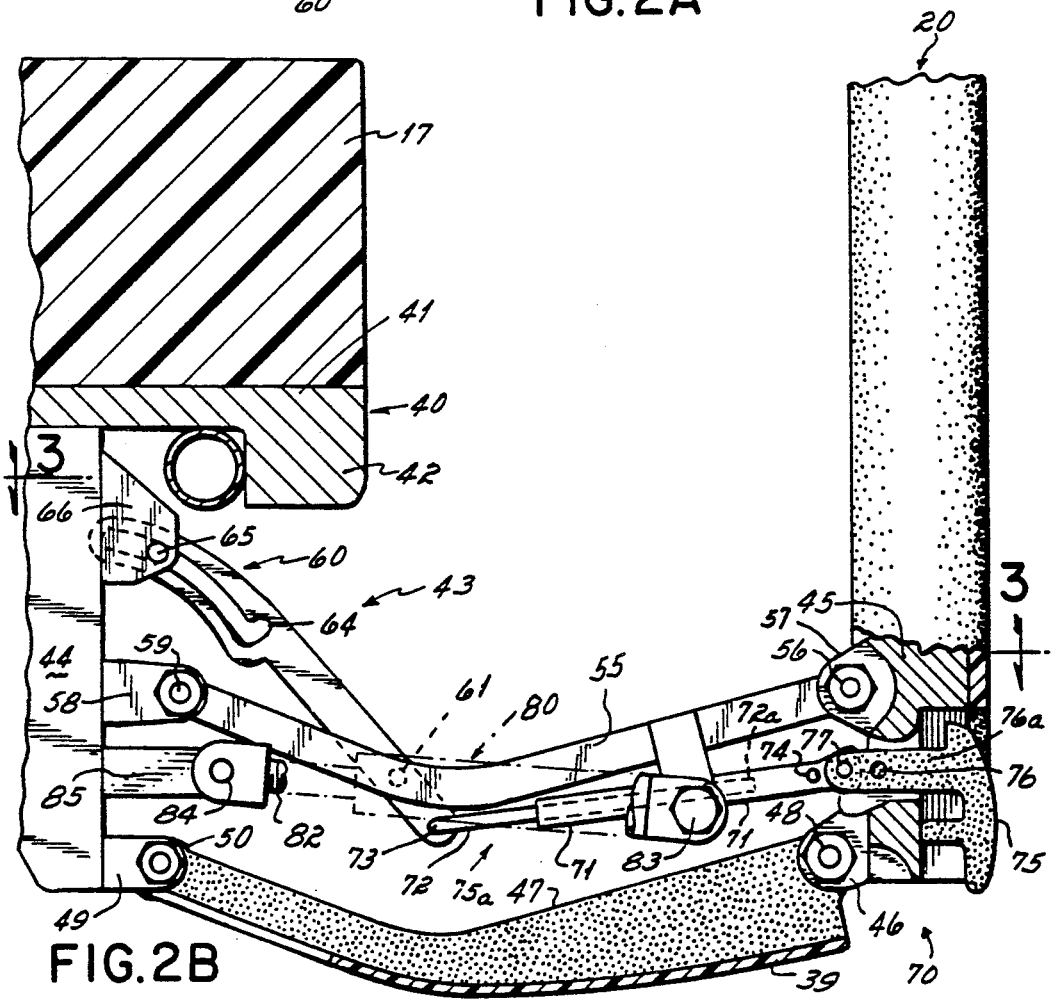
FIG. 2B is a cross-sectional view similar to FIG. 2 showing the side guard halfway between the upper and lower positions.
Figure 2C:
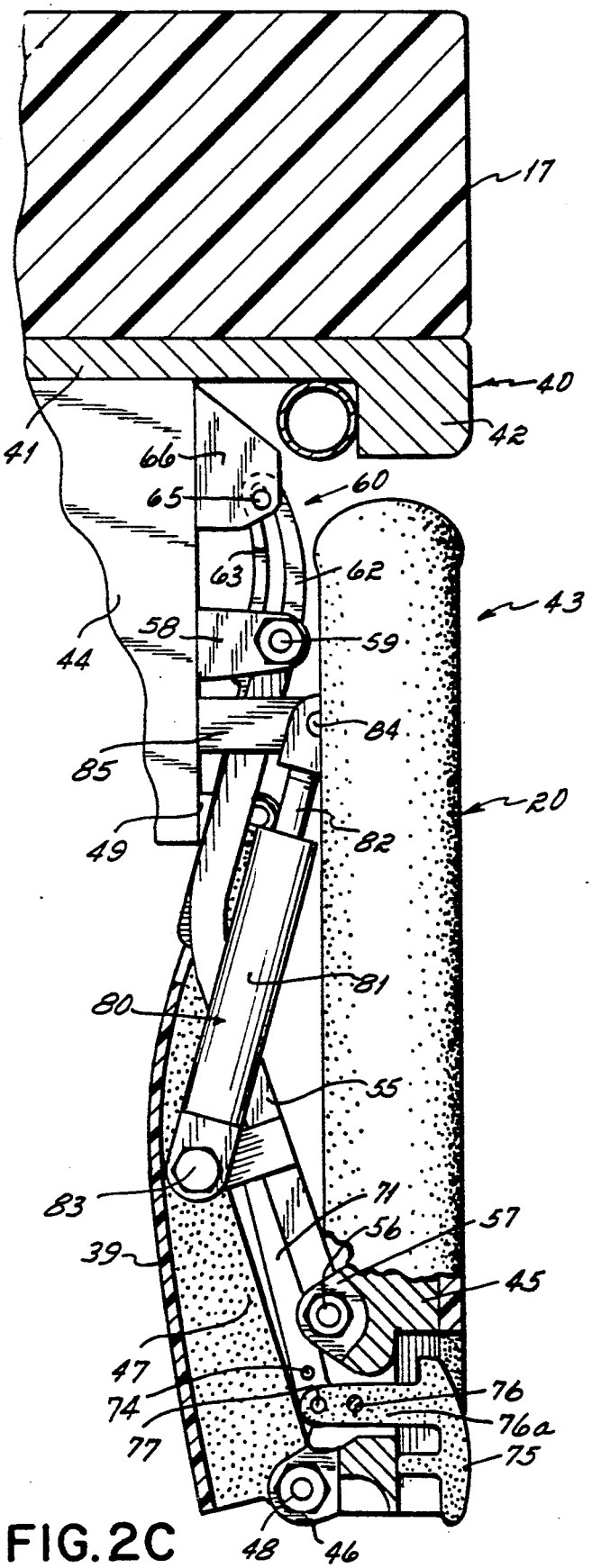
FIG. 2C is a cross-sectional view similar to FIG. 2 showing the side guard in a lower position.
Figure 3:
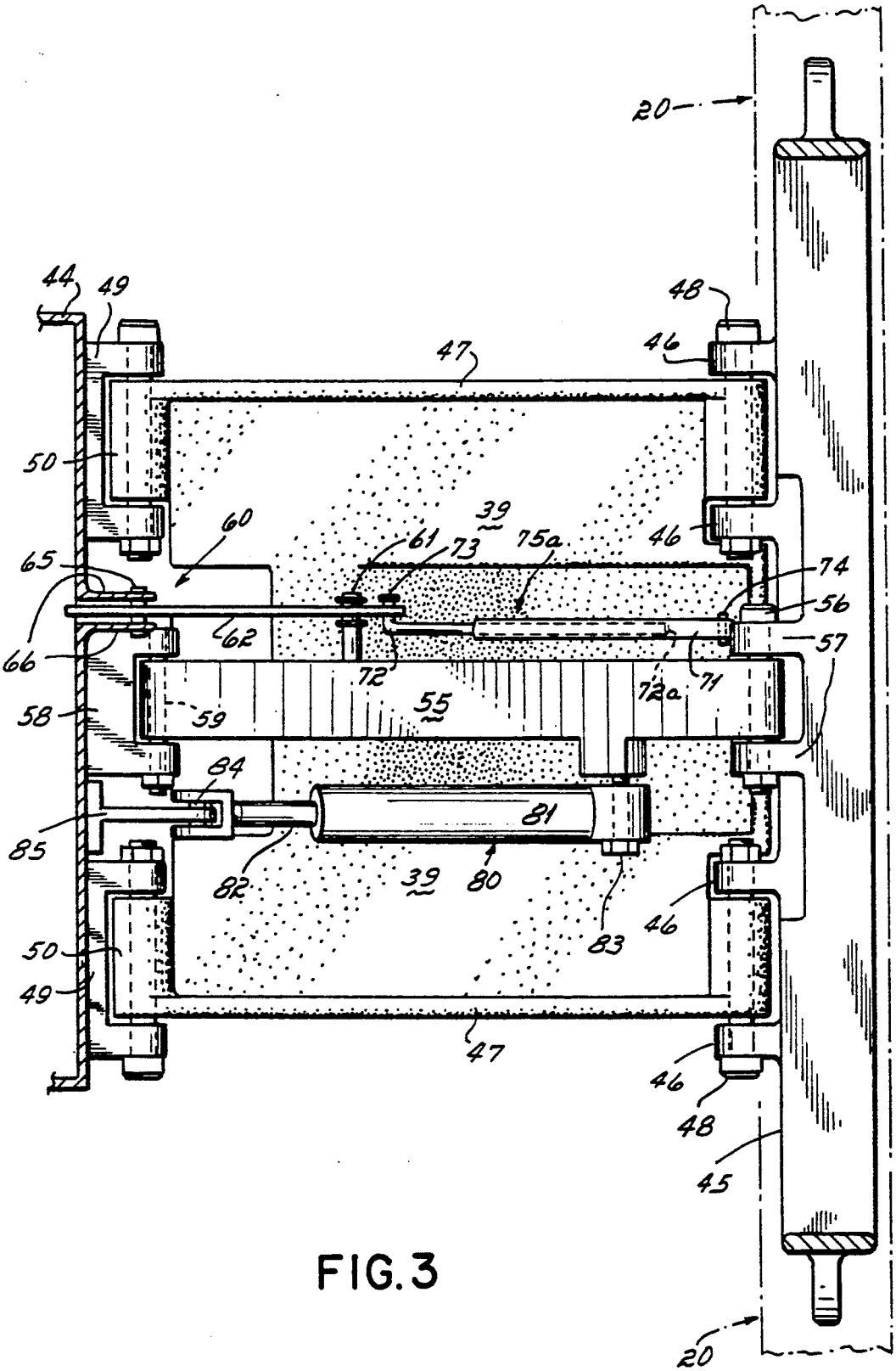
FIG. 3 is a cross-sectional view taken along lines 3—3 of FIG. 2B.

The mounting of the side guard can best be understood by reference to FIGS. 2B and 3. The head panel 17 has a frame 40. A patient support surface 41 is mounted on the frame and has a portion 42 overhanging the frame, thereby creating a storage area 43 for the receipt of the side guard as illustrated in FIG. 2C.

Referring particularly to FIGS. 2 and 3, the side guard panel 25 is supported by an inner casting 45. Two pairs of longitudinally-spaced lower lugs 46 project from the casting 45. A cast facing panel 39 provides a pair of mirror image links 47, each having an end pivotally connected by a bolt 48 to the pair of lugs 46. A cast bracket 44 depends from the frame 40. This bracket has two lower clevices 49 which receive the other ends 50 of the links 47.

Spaced above the links 47 is a center link 55. It is pivotally connected at one end by a bolt 56 to a pair of spaced lugs 57 projecting from the casting 45. The other end of the link 55 is pivotally mounted to a clevice 58 protruding from the casting 45. A bolt 59 provides the mounting of the link to the clevis. The link 55 on one hand and the pair of links 47 of the panel 39 on the other hand together form a parallelogram linkage by which the side guard 20 is pivotally mounted to the birthing bed for movement between an upper operative position of FIG. 2 through an intermediate position of FIG. 2B to a lower storage position of FIG. 2C. When in the storage position of FIG. 2C, it can be seen that the side guard is tucked out of the way underneath the overhanging portion 42 of the patient support.

Referring to FIGS. 2A, 2B and 3, the latch mechanism 60 by which the side guard is held in its upper operative position is illustrated. A latch bar 62 is pivoted at 61 to the center link 55. One end of the latch bar 62 has an elongated slot 63 with a detent notch 64. A pin 65 mounted on a bracket 66 fixed to the bracket 44 rides in the slot 63. When the latch bar is in the horizontal attitude of FIG. 2 with the side guard in its raised, operative position, the pin 65 is lodged in the notch 64 and releasably held there by a spring **64*a* to assure positive locking of pin 65 in notch 64. In such latched condition, the link 55** is precluded from swinging away from the head panel to drop the side guard.

A latch release mechanism 70 is provided. It consists of a telescoping link assembly **75*a* and a release pad 75. The link assembly 75*a* consists of a rod 72 pivoted at one end 73 to link 62. The free end of rod 72 is slidably received in the open end of a tube 71. The tube 71 has a closed end pivoted at 77 to the release pad 75, the closed end being closed by a pin 74. When the pad 75 is in a raised or release position (FIG. 2A), the end 72*a* of rod abuts the pin 74. However, the sliding relationship between rod 72 and tube 71 will permit the assembly 75*a* to lengthen as the side guard is lowered. By reference to FIG. 2A, it can be seen that when the release pad 75 is lifted about pivot 76, the link assembly 75*a* is pushed down. The link assembly 75*a* will cause the latch bar 62 to pivot in the direction of the arrow, thereby overcoming the pressure of spring 64*a* and disengaging the notch 64 from the pin 65**. When disengaged, the parallelogram linkage is free to swing, thereby permitting the side guard to drop.

The release pad 75 has a leg **76*a* which is pivoted at 76 to the casting 45, the pivot 76 being intermediate the pivot 77 and the outer surface. Raising of outer surface of release pad 75 will move pivot 77 downwardly in the direction of the arrow depicted in FIG. 2A** to release the latch.

A dashpot 80 consisting of a cylinder 81 and a piston 82 are mounted between the bracket 44 and the parallelogram linkage to slow the descent of the side guard when it is unlatched and dropped. The cylinder 81 is pivoted by a bolt 83 to the link 55. The piston rod 82 is pivoted at 84 to a lug 85 fixed to the bracket 44.

In the operation of the invention, each side guard is in its normal raised operative position illustrated in FIG. 1. There, the side guard is securely held in position by the latch 60. The controls 26 on the side guard are accessible to the patient or the attending nurse for raising the bed or adjusting the support panels 16, 17 and 18 for the patient's comfort. One or both side guards can be gripped by the mother to assist her in entering and exiting the bed, it being noted that at delivery time the movements of the mother are somewhat cumbersome and awkward.

One comfortable position for labor has the mother on her knees. Such a position is depicted in FIG. 1A. Through the combination of being able to raise and lower the leg panel 18, the possibility of changing the angle of inclination of the back panel 17 and the many available positions on the handrail 30 of the side guard, the delivering mother can assume any of almost an infinite variety of kneeling positions for her comfort.

If the side guard is to be dropped to storage position, that is simply done. The release pad 75, easily accessible at the bottom of the side guard, is pulled outwardly to pivot the leg **76*a* against the link assembly 75*a*. The downward movement of the link assembly 75*a* pivots the latch bar 62 thereby releasing notch 64 from pin 65 to release the side guard. The side guard can be lowered. It can also be dropped. If dropped, no undesirable crashing of the side guard against the bed at the bottom of its descent will occur. The dashpot 80 absorbs the force of the descent and causes the side guard to ease slowly into its storage position. As depicted in FIG. 2C**, the storage position puts the side guard out of the way under the overhang of the head panel.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof. For example, although the present invention has been described as particularly applicable to a birthing bed, it will be recognized that it could be used on hospital beds in general.

We claim:

1. In a birthing bed having a base, a main frame mounted on said base and body support panels including an upwardly pivotable head panel, a side guard on each side of said head panel to pivot with said head panel comprising:

a longitudinal, vertically-oriented panel mounted on said head panel, an inverted U-shaped handrail spaced from said longitudinal panel and having spaced ends fixed to the ends of said longitudinal panel to provide a gripping bar to assist in the laboring process, a foot panel at the end of the bed opposite the head panel, and means for raising and lowering the foot panel, whereby a mother, kneeling on said lowered foot panel, can grasp said U-shaped handrail.

2. In a birthing bed having a base, a main frame mounted on said base and body support panels including an upwardly pivotable head panel, a side guard on each side of said head panel to pivot with said head panel comprising:

a longitudinal member, a control panel mounted on said longitudinal member and having an arcuate upper edge, an inverted U-shaped handrail having longitudinally-spaced ends fixed to said longitudinal member, said handrail being spaced from said control panel along its length to create a substantially uninterrupted slot into which the hands of the patient can be inserted to provide a gripping bar with an infinite number of gripping positions along its length, a foot panel at the end of the bed opposite the head panel, and means for raising and lowering the foot panel, whereby a mother, kneeling on said lowered foot panel, can grasp said U-shaped handrail.

3. A side guard mounted on an upwardly pivotable head panel comprising:

a vertically-oriented lower longitudinal panel and bed controls mounted on a vertical surface of said panel, a labor-assisting handrail projecting upwardly from said panel, a parallelogram linkage connecting said longitudinal panel to said head panel to permit said side guard to swing from a position along the side of and above said head panel to protect the patient to a position completely underneath said head panel to permit access to the patient, said panel retaining its vertical orientation in both positions, thereby presenting said controls in a conveniently accessible attitude.

4. A side guard as in claim 3 further comprising:

a bracket projecting downwardly from said head panel, said bracket having a vertical surface spaced inwardly from the side edge of said head panel, said parallelogram linkage being mounted on said vertical surface of said bracket, and means connected between said bracket and said side guard for releasably latching said side guard in its position above said head panel.

5. A side guard as in claim 3 further comprising:

a piston and cylinder dashpot connected between said side guard and said bracket to ease said side guard into its position under said head guard.

6. In a bed having a frame and a head panel mounted on said frame and overhanging said frame, a side guard comprising:

a vertical panel, two laterally-spaced links pivotally mounted between said vertical panel and said frame, said links being pivotally mounted on a first axis to said frame and on a second axis to said vertical panel, a central link pivotally mounted to said frame on a third axis spaced above said first axis, said central link being pivotally mounted to said panel on a fourth axis spaced above said second axis, thereby creating a parallelogram linkage between said vertical panel and said frame, and a facing extending across said laterally-spaced links to conceal said parallelogram linkage.

7. A side guard as in claim 6 further comprising, a latch bar pivoted at one end to one of said links, said latch bar having an elongated slot and a detent notch, a pin fixed to said frame and receiving said slot, said pin, when lodged in said detent notch, holding said side guard in a vertical position, and release means mounted on said facing and connected to said latch bar for shifting said latch bar to move said detent notch away from said pin to release said side guard.

* * * * *